US008365469B2

(12) United States Patent
Kowalczyk et al.

(10) Patent No.: US 8,365,469 B2
(45) Date of Patent: Feb. 5, 2013

(54) DOOR OPERATING SYSTEM

(75) Inventors: Thomas M. Kowalczyk, Farmington, CT (US); Michael S. Tignor, Watertown, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 944 days.

(21) Appl. No.: 11/729,986

(22) Filed: Mar. 30, 2007

(65) Prior Publication Data

US 2008/0236048 A1 Oct. 2, 2008

(51) Int. Cl.
*E05F 11/00* (2006.01)

(52) U.S. Cl. ..... 49/139; 49/334; 49/340; 49/324; 49/140

(58) Field of Classification Search ..... 49/324, 49/339, 333, 334, 340, 345, 139, 140
See application file for complete search history.

(56) References Cited

U.S. PATENT DOCUMENTS

| | | | | | |
|---|---|---|---|---|---|
| 2,893,506 | A | * | 7/1959 | Daugirdas | 180/286 |
| 3,087,720 | A | | 4/1963 | Catlett | |
| 3,210,067 | A | * | 10/1965 | Ferguson et al. | 74/42 |
| 3,470,653 | A | | 10/1969 | Kalog | |
| 4,045,914 | A | | 9/1977 | Catlett | |
| 4,048,694 | A | * | 9/1977 | Newman et al. | 16/52 |
| 4,080,687 | A | | 3/1978 | Jentsch | |
| 4,160,389 | A | | 7/1979 | Kubono | |
| 4,220,051 | A | | 9/1980 | Catlett | |
| 4,289,995 | A | | 9/1981 | Sorber et al. | |
| 4,333,270 | A | | 6/1982 | Catlett | |
| 4,429,490 | A | | 2/1984 | Zunkel | |
| 4,454,685 | A | * | 6/1984 | van der Sloot et al. | 49/110 |
| 4,658,545 | A | | 4/1987 | Ingham et al. | |
| 4,895,048 | A | | 1/1990 | Key et al. | |
| 5,018,304 | A | | 5/1991 | Longoria | |
| 5,243,735 | A | | 9/1993 | O'Brien, II | |
| 5,272,787 | A | | 12/1993 | Salena et al. | |
| 5,317,934 | A | | 6/1994 | Zannis | |
| 5,332,279 | A | * | 7/1994 | Golemis et al. | 296/146.4 |
| 5,375,374 | A | * | 12/1994 | Rohraff, Sr. | 49/340 |
| 5,417,011 | A | * | 5/1995 | Keszthelyi | 49/334 |
| 5,771,635 | A | * | 6/1998 | Skinner | 49/25 |
| 5,881,497 | A | | 3/1999 | Borgardt | |
| 6,067,753 | A | | 5/2000 | Hebda | |
| 6,430,871 | B1 | | 8/2002 | Hebda | |
| 6,634,140 | B1 | | 10/2003 | Sellman | |
| 6,694,674 | B2 | | 2/2004 | Son | |
| 6,891,479 | B1 | | 5/2005 | Eccleston | |
| 6,915,608 | B2 | | 7/2005 | Labarre | |
| 7,068,179 | B2 | | 6/2006 | Snell et al. | |

(Continued)

*Primary Examiner* — Gregory J. Strimbu
(74) *Attorney, Agent, or Firm* — Pillsbury Winthrop Shaw Pittman LLP

(57) ABSTRACT

A door operator operates a door that is rotatable about an axis of rotation between an open position and a closed position. The door operator comprises an output shaft, a closing assembly, and a motor. The output shaft is rotatable between a first position and a second position, and is coupled to the door such that rotation of the output shaft pivots the door about the axis of rotation and rotation of the door about the axis of rotation rotates the output shaft. The closing assembly is coupled to the output shaft to apply a torque to the output shaft, wherein the torque applied by the closing assembly rotates the output shaft such that the rotation of the output shaft by the closing assembly rotates the door toward the closed position. The motor is coupled to the output shaft via a clutch to selectively apply opening and/or closing torque to the output shaft.

6 Claims, 11 Drawing Sheets

U.S. PATENT DOCUMENTS

| | | | | |
|---|---|---|---|---|
| 7,143,547 | B2 | 12/2006 | Liles, Jr. | |
| 7,316,096 | B2 * | 1/2008 | Houser et al. | 49/345 |
| 7,484,333 | B2 * | 2/2009 | Houser et al. | 49/506 |
| 2005/0091928 | A1 | 5/2005 | Okulov et al. | |
| 2005/0172559 | A1 | 8/2005 | Hsieh | |
| 2005/0178066 | A1 | 8/2005 | Drux et al. | |
| 2006/0010771 | A1 | 1/2006 | Houser et al. | |
| 2006/0090861 | A1 | 5/2006 | Wu | |

* cited by examiner

DOOR OPERATING SYSTEM

FIELD OF THE INVENTION

The invention relates to door operating systems.

BACKGROUND OF THE INVENTION

Door operating assemblies that include a motor that is coupled to a door to drive the door from a closed to an open position are known. Similarly, closing assemblies that apply a torque to a door that biases the door towards its closed position are known. However, conventional systems generally to not combine the driving functionality of known door operating assemblies with the closing capabilities of known closing assemblies. Further, conventional door operating assemblies that include a motor configured to drive a door open tend to couple the motor to the door such that one or more of closing of the door, manual operation (e.g., manual opening and/or closing) of the door, or an overdriving of the door (e.g., past its open position) may damage (or at least cause wear to) the motor of the door operating assembly.

Generally, conventional door operating assemblies do not enable a user that is installing, maintaining, and/or fixing a door operating assembly to access information related to the functionality of the door operating assembly. This may aggravate maintenance problems, impede troubleshooting, and/or complicate installation of the door operating assembly and/or its components.

SUMMARY

One aspect of the invention relates to a door operator configured to operate a door that is rotatable about an axis of rotation between an open position and a closed position. In one embodiment, the door operator comprises an output shaft, a closing assembly, and a motor. The output shaft is rotatable between a first position and a second position, and is coupled to the door such that rotation of the output shaft pivots the door about the axis of rotation and rotation of the door about the axis of rotation rotates the output shaft. The closing assembly is coupled to the output shaft to apply a torque to the output shaft, wherein the torque applied by the closing assembly rotates the output shaft such that the rotation of the output shaft by the closing assembly rotates the door toward the closed position. The motor is coupled to the output shaft to (i) engage the output shaft to apply a torque to the output shaft that rotates the output shaft from the first position to the second position, (ii) disengage the output shaft once the output shaft reaches the second position to enable the output shaft to rotate from the second position to the first position free from engagement with the motor, and (iii) enable the output shaft to rotate between the first position and the second position free from engagement with the motor if the door is manually opened.

Another aspect of the invention relates to A door operator configured to operate a door that is rotatable about an axis of rotation between an open position and a closed position. In one embodiment the door operator comprises a four bar linkage, an output shaft, and a motor. The four bar linkage comprises a first fixed pivot, a second fixed pivot, a first floating pivot, a second floating pivot, a first member that forms a bar in the four bar linkage that extends from the first fixed pivot to the first floating pivot, a second member that forms a bar in the four bar linkage that extends from the first floating pivot to the second floating pivot, and a third member that forms a bar in the four bar linkage that extends from the second floating pivot to the second fixed pivot. The output shaft is rotatable between a first position and a second position, and is coupled to the door such that rotation of the output shaft pivots the door about the axis of rotation and rotation of the door about the axis of rotation rotates the output shaft, wherein the output shaft forms the first fixed pivot of the four bar linkage and the first member is coupled to the output shaft such that the output shaft rotates from the first position to the second position as the first member pivots about the output shaft in a first rotational direction. The motor is configured to drive the third member to pivot about the second fixed pivot such that the motion of the third member drives the first member to pivot about the output shaft in the first rotational direction, which drives rotation of the output shaft from the first position to the second position.

Another aspect of the invention relates to a door operator configured to operate a door that is rotatable about an axis of rotation between an open position and a closed position. In one embodiment, the door operator comprises an output shaft, an operating assembly, a controller, and an interface. The output shaft is rotatable between a first position and a second position, and is coupled to the door such that rotation of the output shaft pivots the door about the axis of rotation and rotation of the door about the axis of rotation rotates the output shaft. The operating assembly is configured to operate the door by applying a torque to the output shaft to rotates the output shaft between the first and second positions. The controller is in operative communication with the operating assembly, wherein the controller is configured to receive information related to the operation of the operating assembly and to model the operation of the operating assembly as a state machine based on the received information. The interface is operatively connected to the controller, wherein the interface conveys information related to the state of the state machine to a user.

Another aspect of the invention relates to a method of initializing a door operating system configured to operate a door. In one embodiment, the method comprises initiating an initialization of the door operating system; rotating a motor that is coupled to the door in a direction that drives the door closed until the rotation of the motor is impeded; setting the rotational position of the motor when it is impeded as a reference position; and determining one or more operational positions of the motor relative to the reference position.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
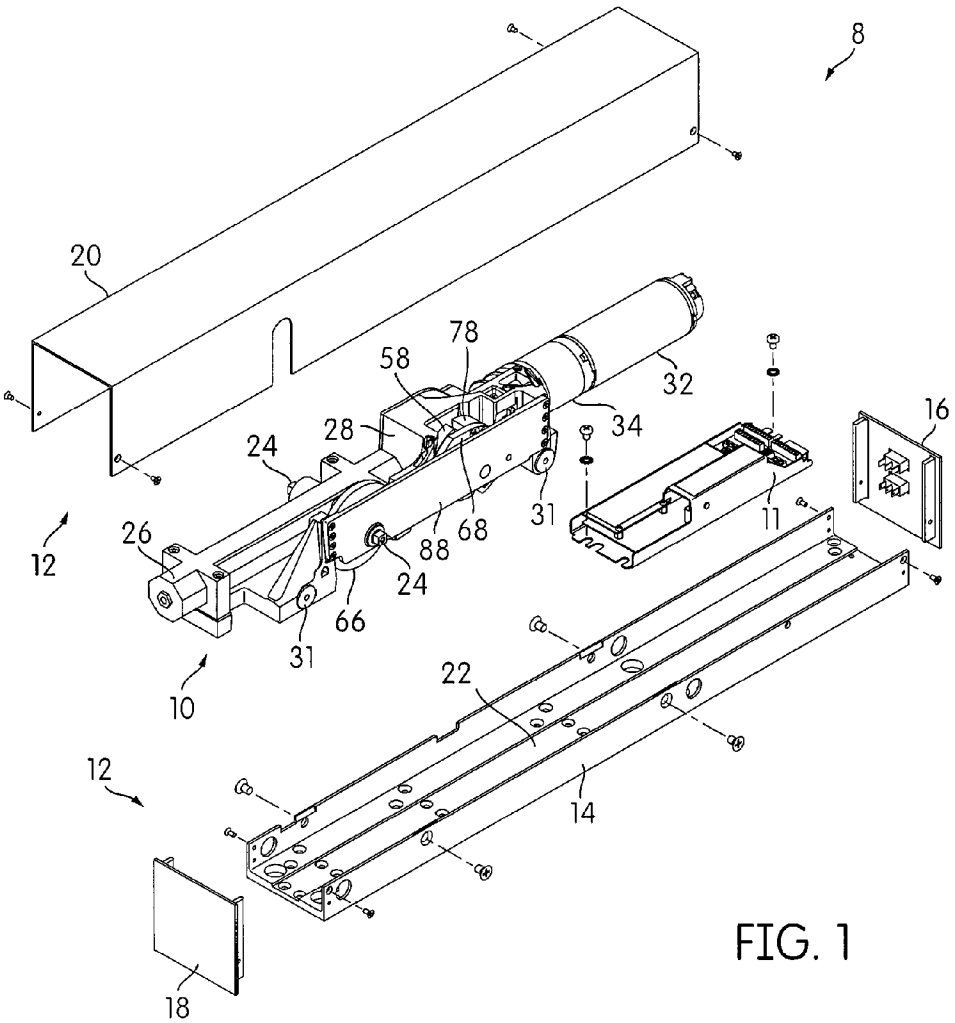
FIG. 1 illustrates an exploded view of a door operating system, in accordance with one or more embodiments of the invention.

FIG. 1 illustrates an exploded view of a door operating system 8 that is configured to operate a door (not shown in FIG. 1), according to one or more embodiments of the invention. The door is rotatable about an axis of rotation between an open position and a closed position. As can be seen in FIG. 1, system 8 includes a door operating assembly 10, a controller 11, and a housing 12 that houses door operating assembly 10. In one embodiment, housing 12 includes a bracket 14, a first end plate 16, a second end plate 18, and a cover 20.

Bracket 14 is mountable to a wall structure to secure assembly 10 to a wall proximate to a door being operated by system 8. An inner surface 22 of bracket 14 is formed to provide a seat for assembly 10 and controller 11. First end plate 16 is mounted to a first side of bracket 14 to provide a wall of housing 12 on the first side of assembly 10. Second end plate 18 is mounted to a second side of bracket 14 to provide a wall of housing 12 on the second side of assembly 10. Cover 20 is mounted to bracket 14 to enclose housing 12. Cover 20 and/or plates 16 and 18 may be removed once assembly 10 and controller 11 have been installed to provide access to assembly 10 and/or controller 11 (e.g., for maintenance, etc.).

Controller 11 controls one or more of the components of door operating assembly 10. Accordingly, controller 11 provides information storage (e.g., electronic storage) and processing (e.g., electronic processing) capabilities to enable controller to store, access, and/or execute one or more operations or algorithms to control door operating assembly 10 to perform the functionalities discussed herein. In one embodiments, controller 11 is in operative communications with one or more additional components of system 8 (not shown in FIGS. 1 and 2). For example, controller 11 may be in operative communication with a user interface that enables information to be received from or conveyed to a user. For instance, the user interface may include one or more input devices that enable the user to input a command to controller 11 for execution by system 8 (e.g., an open door command, a close door command, etc.). As another example, the user interface may include one or more output devices that convey information to the user that is related to the operation of system 8.

Figure 2:
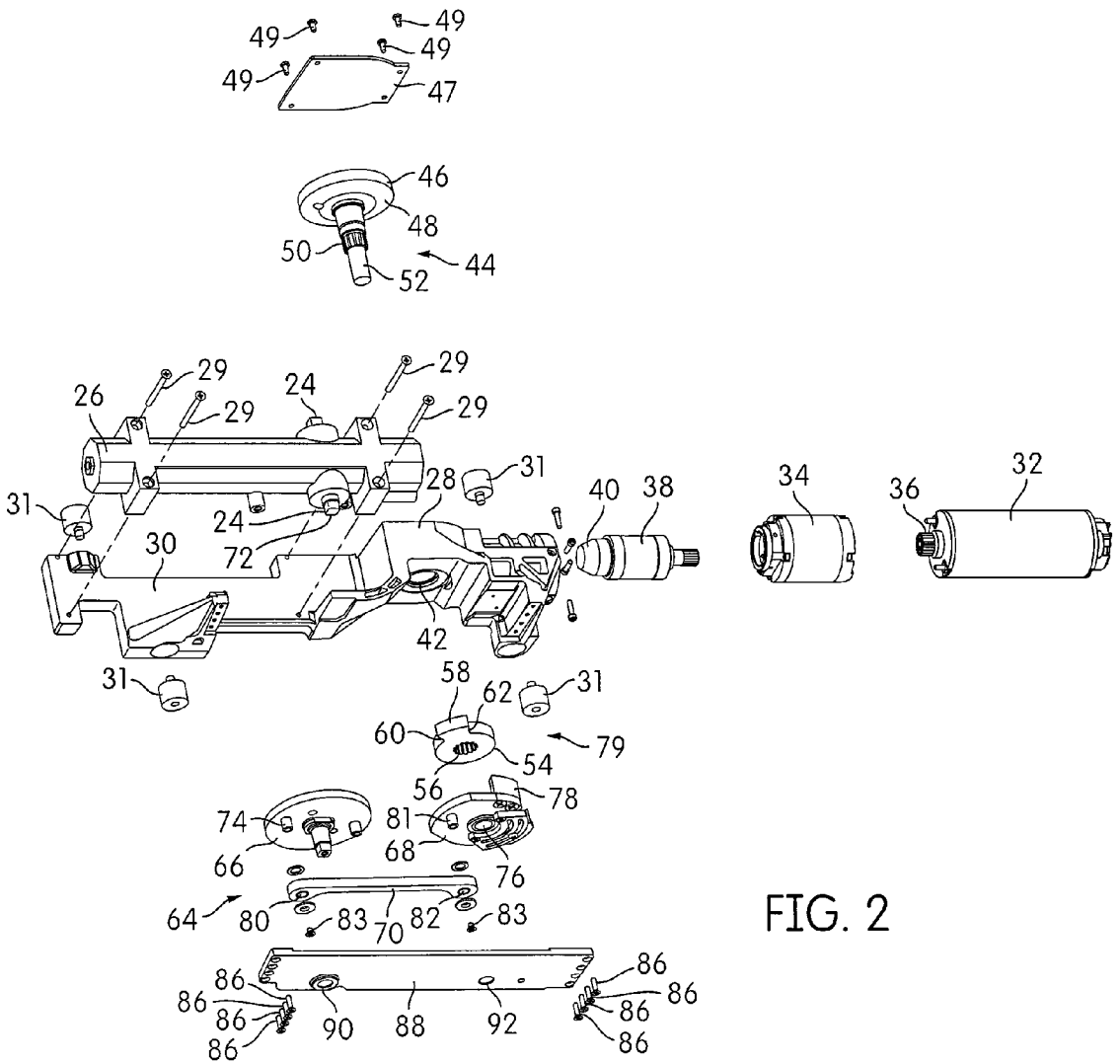
FIG. 2 illustrates an exploded view of a door operating assembly, according to one or more embodiments of the invention.

FIG. 2 illustrates an exploded view of operating assembly. In the embodiment shown, assembly 10 includes an output shaft 24 that is coupled to the door being operated. In one embodiment, output shaft 24 is coupled to the door via a linkage that causes rotation of the output shaft 24 to drive the door to pivot about the axis of rotation between the open and closed positions. Output shaft 24 is rotatable between a first position and a second position such that the first position corresponds to the closed position of the door and the second position corresponds to the open position of the door.

Output shaft 24 is coupled to a closing assembly 26 to apply a torque to output shaft 24. The torque applied by closing assembly 26 to output shaft 24 biases output shaft 24 toward the first position (which corresponds to the door being in the closed position). In one embodiment, closing assembly 26 includes a hydraulic closing.

In use, closing assembly 26 is mounted to a seating body 28 (e.g., via fasteners 29). Seating body 28 is formed to seat closing assembly 26, and other components of assembly 12 discussed below, to hold the components in engagement with each other. Seating body 28 is, in turn, mounted to inner surface 22 of bracket 14. In one embodiment a plurality of isolation mounts 31 are attached to seating body 28 to reduce vibration of the components of system 8 (e.g., assembly 10, housing 12, etc.) during operation. In particular, one or more isolation mounts 31 are placed on each of two opposing sides of seating body 28 such that as seating body is mounted to bracket 14 the mounts 31 on each of the opposing sides engage bracket 14 (e.g., as is shown in FIG. 1). The compression of the mounts 31 on each of the opposing sides of seating body 28 that is applied by bracket 14 retains mounts 31 in place with an enhanced security.

As is illustrated in FIG. 2, assembly 10 includes a motor 32. As is described herein, motor 32 is operable to drive output shaft 24 from the first position to the second position. Assembly 10 is formed to couple motor 32 to output shaft 24 such that once the output shaft 24, under the power of motor 32, reaches the second position, motor 32 is disengaged from output shaft 24. Disengaging output shaft 24 from motor 32 enables output shaft 24 to rotate from the second position to the first position (e.g., under the torque applied by closing assembly 26) without back-driving motor 32. Further, assembly 10 maintains the relationship between output shaft 24 and motor 32 such that when the door is manually operated (e.g., opened and/or closed) by a user, output shaft 24 rotates between the first and second positions free from engagement with motor 32.

Motor 32 is operatively connected to a gearbox 34, which receives a driveshaft 36 that extends from motor 32. As motor 32 rotationally drives driveshaft 36, gearbox 34 transmits mechanical power from driveshaft 36 to an output gear 38. Gearbox 34 may be formed such that one or more properties of the mechanical power transmitted from driveshaft 36 to output gear 38 may be adjusted in transmission. For example, a torque of the mechanical power that is transmitted to output gear 38 may be higher than the mechanical power of driveshaft 36. As another example, the rotational velocity imparted to output gear 38 by gearbox 34 may be lower than the rotational velocity of driveshaft 36.

In one embodiment, when assembly 10 is assembled (e.g., as shown in FIG. 1) motor 32 and gearbox 34 can be seated within housing 12 on bracket 14. Output gear 38 extends from gearbox 34 into a channel (not shown in FIG. 1 or 2) formed within seating body 28. Within the channel, output gear 38 has clearance on all sides so that it is free to rotate within the channel without interference from the surface of the channel. As can be seen in FIG. 1, in one embodiment, output gear 38 includes a bevel surface 40. On bevel surface 40, gear teeth are formed.

From the view shown in FIG. 2, a channel 42 formed in seating body 28 can be seen. Channel 42 communicates with the channel in which output gear 38 is seated during operation. A driven shaft 44 of assembly 10 is configured to rest within, and extend out of, channel 42 when assembly 10 is assembled. Driven shaft 44 is seated within channel 42 such that driven shaft 44 is enabled to rotate about a longitudinal axis within channel 42. A plate 47 is formed to be mounted to seating body 28 (e.g., via fasteners 49) to secure driven shaft 44 within channel 42.

Driven shaft 44 includes a base portion 48 that provides a bevel surface 46 on which gear teeth are formed that are configured to engage the gear teeth formed on bevel surface 40 of output gear 38 such that rotation of output gear 38 drives rotation of driven shaft 44 about the longitudinal axis of driven shaft 44. In other words, bevel surface 40 of output gear 38 and base portion 48 of driven shaft 44 form a bevel drive that translates the rotation of output gear 38 by roughly 90° to rotation of driven shaft 44. Driven shaft 44 also includes a first portion 50 and a second portion 52, which is disposed at the distal end of driven shaft 44. First portion 50 is distinguishable from second portion 52 in that first portion 50 is striated with longitudinal gear teeth while second portion 52 is substantially smooth. In one embodiment, driven shaft 44 is formed as a single contiguous body that includes base portion 48, first portion 50, and second portion 52.

When driven shaft 44 is mounted within channel 42, first portion 50 and second portion 52 protrude out from seating body 28. Assembly 10 includes a drive gear 54 that is adapted to be mounted on driven shaft 44 in a rotationally fixed relationship with driven shaft 44. Specifically, drive gear 54 forms an opening 56 adapted to receive driven shaft 44 therethrough. Gear teeth are formed within opening 56 that cooperate with first portion 50 of driven shaft 44 such that as opening 56 becomes seated over first portion 50, the gear teeth formed on opening 56 engage the gear teeth formed on first portion 50 to hold drive gear 54 and driven shaft 44 in a rotationally fixed relationship.

As can be seen in FIG. 2, drive gear 54 is formed as a generally planar member. Drive gear 54 includes a protrusion 58. Protrusion 58 protrudes from drive gear 54 in the general plane of drive gear 54. Protrusion 58 is formed in part by a first protruding surface 60, located at the leading edge of protrusion 58 as drive gear 54 rotates in a clockwise direction (when viewing gear 54 from the opposite side from seating body 28), and a second protruding surface 62, located at the trailing edge of protrusion 58 as drive gear 54 rotates in the clockwise direction. It should be appreciated that although protrusion 58 is shown in FIG. 2 as being formed integrally with drive gear 54, this is for illustrative purposes only. In other embodiments, protrusion 58 may be separately formed and attached to drive gear 54.

As illustrated in FIG. 2, door operating assembly 10 includes a linkage 64 that couples motor 32 to output shaft 24. As will be discussed further below, one or more components of linkage 64 move in a fixed relationship with the rotation of output shaft 24. Mechanical power generated by motor 32 is implemented to drive one or more members of linkage 64, thereby driving rotation of output shaft 24. However, the arrangement of linkage 64 is such that if the door is operated manually, motion of linkage 64 caused by the manual operation does not engage motor 32. In one embodiment, linkage 64 includes a first linkage gear 66, a second linkage gear 68, and a bar 70.

First linkage gear 66 is formed as a generally planar gear that is mounted to output shaft 24 to rotate about an axis of rotation that coincides with the longitudinal axis of output shaft 24. First linkage gear 66 is mounted to output shaft 24 in a fixed rotational relationship with output shaft 24 (i.e., first linkage gear 66 and output shaft 24 rotate together). In the embodiment shown in FIG. 2, output shaft 24 includes a keyed end 72 (e.g., formed in the shape of a square protrusion). Although not visible in FIG. 2, first linkage gear 66 includes a coordinating first portion (e.g., formed to include a square socket that receives the square protrusion of keyed end 72 of output shaft 24) that engages keyed end 72 of output shaft 24 as first linkage gear 66 is mounted to output shaft 24 such that first linkage gear 66 and output shaft 24 are held in a fixed rotational relationship. First linkage gear 66 includes a pivot point 74 formed at a location on first linkage gear 66 that is radially displaced from the axis of rotation of first linkage gear 66. In one embodiment, pivot point 74 is formed as a protrusion from first linkage gear 66 out of the general plane of gear 66.

Second linkage gear 68 is formed as a generally planar gear that is mounted to driven shaft 44 to rotate about an axis of rotation that coincides with the longitudinal axis of driven shaft 44. Second linkage gear 68 is mounted to driven shaft 44 on second portion 52 and adjacent to drive gear 54. Unlike drive gear 54, second linkage gear 68 rotates independently from driven shaft 44. To this end, second linkage gear 68 forms an opening 76 adapted to receive second portion 52 of driven shaft 44. In some instances, an inner surface of opening 76 is formed as a relatively smooth surface (similarly to second portion 52 of driven shaft 44) and the inner surface of opening 76 and second portion 52 of driven shaft 44 slide against each other without producing substantial friction. In other instances, bearings may be placed between second portion 52 of driven shaft 44 and the inner surface of opening 76 that enable driven shaft 44 and second linkage gear 68 to be rotated independently from each other. Second linkage gear 68 includes a protrusion 78 that extends out of the general plane of gear 68 and into the general plane of drive gear 54 when both second linkage gear 68 and drive gear 54 are mounted on driven shaft 44. As shown in FIG. 2, in one embodiment, protrusion 78 is formed separately from second linkage gear 68 and is attached thereto. In another embodiment, however, protrusion 78 may be formed integrally with second linkage gear 68 as a single component. As is discussed further below with respect to FIGS. 3A-7B, the interaction between protrusions 58 and 78 form a hysteresis dog clutch 79 that couples motor 32 to second linkage gear 68 to drive rotation of gear 68 about its axis of rotation (i.e., driven shaft 44). Second linkage gear 68 includes a pivot point 81 formed at a location on second linkage gear 68 that is radially displaced from the axis of rotation of second linkage gear 68. In one embodiment, pivot point 81 is formed as a protrusion from second linkage gear 68 out of the general plane of gear 68.

Bar 70 is an armature that operatively connects first linkage gear 66 with second linkage gear 68. Bar 70 forms a first opening 80 at a first end and a second opening 82 at a second end. First opening 80 is adapted to be coupled to pivot point 74 (e.g., by a fastener 83) of first linkage gear 66 such that bar 70 pivots freely about pivot point 74. Second opening 82 is adapted to be coupled to pivot point 81 (e.g., by a fastener 83) of second linkage gear 68 such that bar 70 pivots freely about pivot point 81.

In one embodiment, assembly 10 includes a plate 88 that sits over linkage 64 when assembly 10 is assembled and is attached to seating body 28 by fasteners 86. Plate 88 forms openings 90 and 92 to ensure that plate 88 does not impede the rotation of output shaft 24 or drive shaft 44. This is illustrated, for example, in FIG. 1.

Figure 3A:
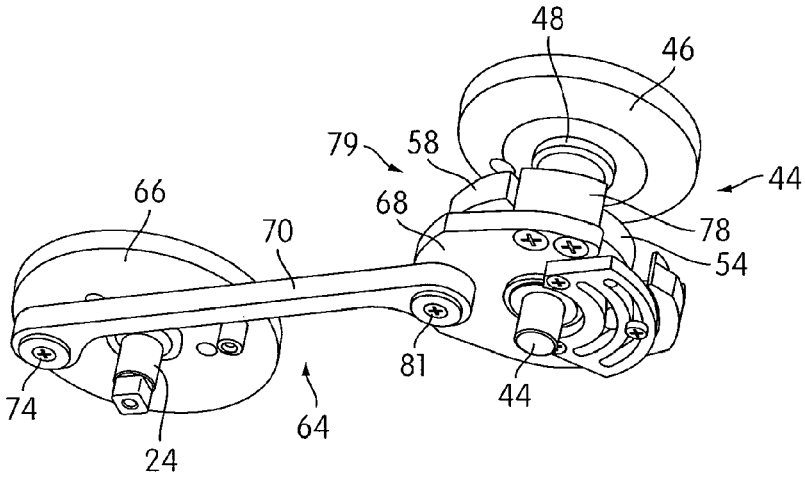
FIGS. 3A and 3B illustrate a linkage and a clutch, in accordance with one or more embodiments of the invention.

FIGS. 3A-7B illustrate various aspects of the operation of linkage 64 and clutch 79. For example, FIGS. 3A and 3B show the positioning of linkage 64 and clutch 79 if the door being operated by assembly 10 is closed (i.e., output shaft 24 is in the first position), and motor 32 has been operated to position drive gear 54 and its protrusion 58 in a default position. More particularly, FIG. 3A is an isometric perspective of this configuration, while FIG. 3B is an elevation of this configuration in which various components are visible only in hidden lines. From the views of the assembled linkage 64 and clutch 79 illustrated in FIGS. 3A and 3B, it can be seen that linkage 64 includes four bar linkage made up of a first fixed pivot (formed by output shaft 24), a second fixed pivot (formed by driven shaft 44), a first floating pivot (formed by pivot point 74), a second floating pivot (formed by pivot point 81), a first member (formed by first linkage gear 66) that functions as a bar in the four bar linkage extending from the first fixed pivot (i.e., output shaft 24) to the first floating pivot (i.e., pivot point 74), a second member (formed by bar 70) that functions as a bar in the four bar linkage extending from first floating pivot (i.e., pivot point 74) to the second floating pivot (i.e., pivot point 81), and a third member (formed by second linkage gear 68) that functions as a bar in the four bar linkage extending form the second floating pivot (i.e., pivot point 81) to the second fixed pivot (i.e., driven shaft 44).

Figure 3B:
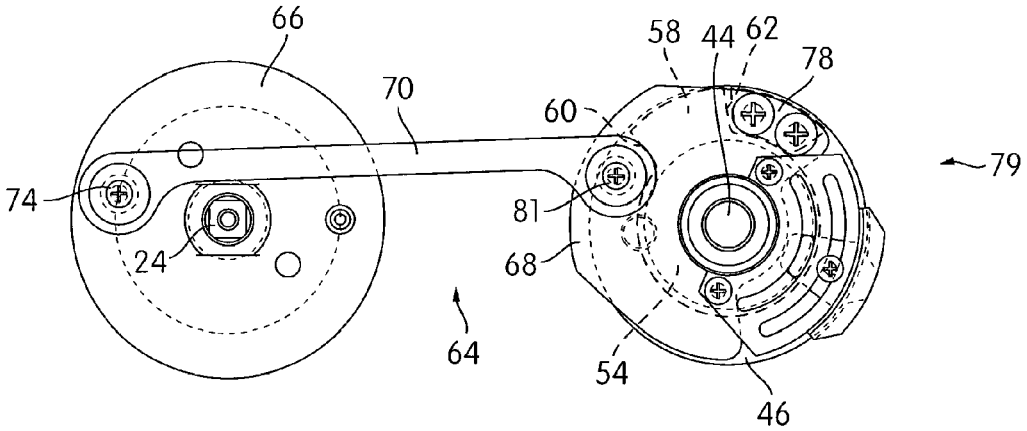

As is shown in FIGS. 3A and 3B, if the door is closed and drive gear 54 is positioned in its default position, protrusion 78 extends from second linkage gear 68 into the plane of drive gear 54 and is proximate to protrusion 58 of drive gear 54. In particular, second protruding surface 62 of protrusion 58 in the orientation shown in FIGS. 3A and 3B is close to, or abutting, a corresponding surface of protrusion 78. Linkage 64 and clutch 79 are generally in the positions of FIGS. 3A and 3B, unless the door to which door operating assembly 10 is connected is being operated (either by assembly 10, or manually operated).

If door operating assembly 10 receives a command to open the door, motor 32 drives driven shaft 44 such that drive gear 54 is rotated in a clockwise direction (as shown in FIGS. 3A-7B). This causes clutch 79 to engage linkage 64 to rotationally drive second linkage gear 68. Specifically, rotation of drive gear 54 in the clockwise direction engages second protruding surface 62 of protrusion 58 with protrusion 78 and drives protrusion 78 to rotate about the axis of rotation of second linkage gear 68 (i.e., driven shaft 44) in coordination with the rotation of drive gear 54.

Figure 4A:
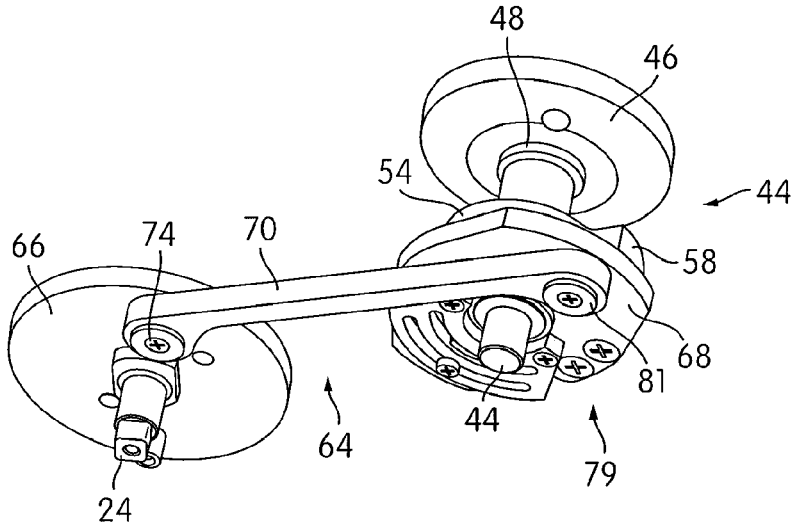
FIGS. 4A and 4B illustrate a linkage and a clutch, in accordance with one or more embodiments of the invention.
Figure 4B:
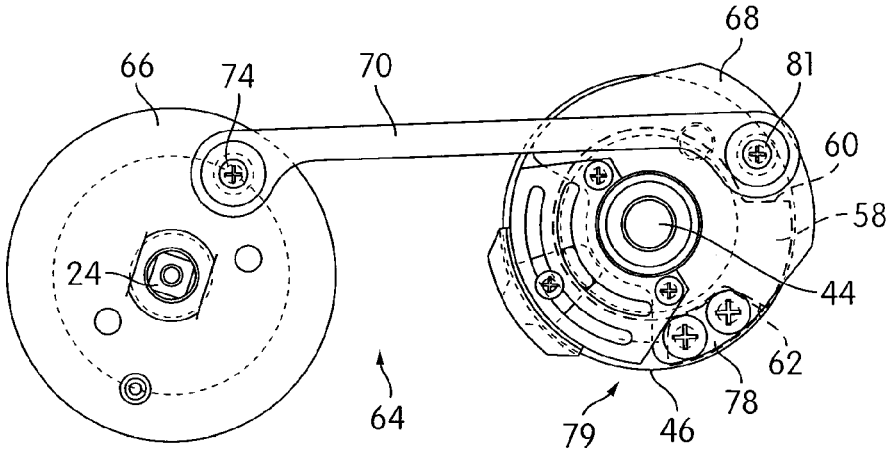

Typically, the rotation of drive gear 54 proceeds until drive gear 54 reaches a rotational orientation that corresponds to the door being in its open position. This position of clutch 79 and linkage 64 is illustrated in FIGS. 4A and 4B. More particularly, FIG. 4A is an isometric perspective of this configuration of clutch 79 and linkage 64, and FIG. 4B is an elevation of this configuration of clutch 79 and linkage 64. As can be seen in these figures, rotation of second linkage gear 68 due to engagement by clutch 79 causes a corresponding rotation of first linkage gear 66 about its axis or rotation (i.e., output shaft 24) due to the coupling of linkage gears 66 and 68 by bar 70. As was described above, first linkage gear 66 is mounted to output shaft 24 in a fixed rotational relationship with output shaft 24. Therefore, rotation of first linkage gear 66 caused by rotation of second linkage gear 68 also causes output shaft 24 to rotate (e.g., from its first position to its second position), which in turn opens the door that is coupled to output shaft 24.

Figure 5A:
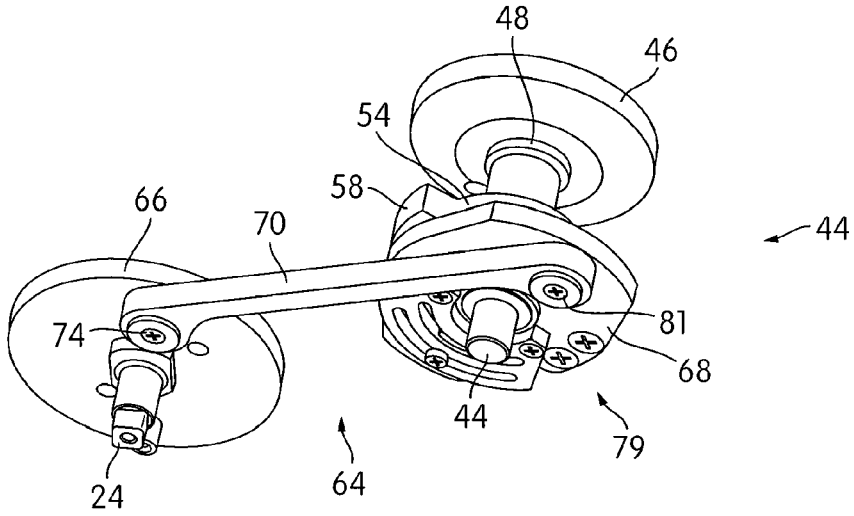
FIGS. 5A and 5B illustrate a linkage and a clutch, in accordance with one or more embodiments of the invention.
Figure 5B:
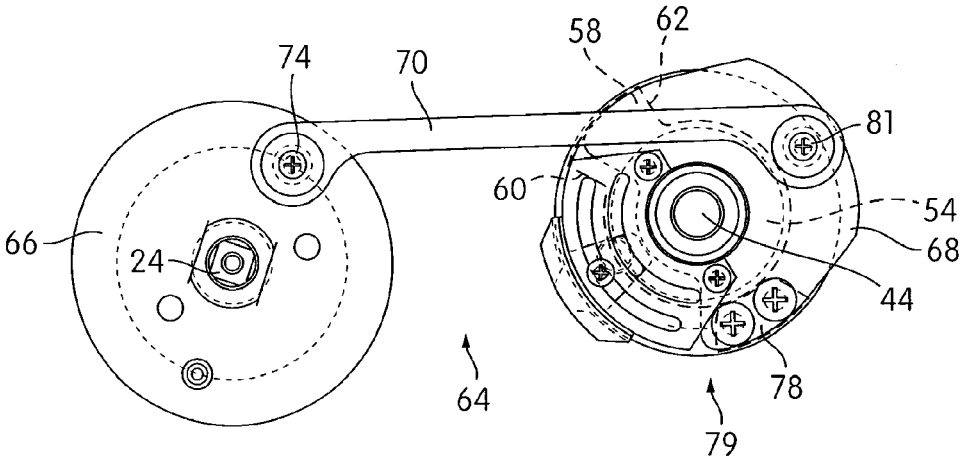

Once motor 32 drives drive gear 54 to the position shown in FIGS. 4A and 4B, and the door has been opened, motor 32 drives drive gear 54 back to its default position, which releases the engagement between clutch 79 and linkage 64. This release of the engagement between clutch 79 and linkage 64 as drive gear 54 is driven back to its default position is illustrated in FIGS. 5A and 5B. Specifically, FIG. 5A is an isometric perspective of this configuration of clutch 79 and linkage 64, and FIG. 5B is an elevation of this configuration of clutch 79 and linkage 64. As can be appreciated from these figures, as drive gear 54 rotates back to its default position, the engagement between second protruding surface 62 of protrusion 58 and protrusion 78 is released. This enables second linkage gear 68 to rotate about its axis of rotation in the counter-clockwise direction back to its default position (e.g., with the door in its closed position).

As was discussed above with respect to FIG. 2, closing assembly 26 (not shown in FIGS. 3A-7B) applies a torque to output shaft 24 that biases output shaft 24 toward its first position. Once second linkage gear 68 has been released by clutch 79 (e.g., as shown in FIGS. 5A and 5B), first linkage gear 66 and second linkage gear 68 are free to rotate in coordination with output shaft 24 under the bias applied by closing assembly 26 (not shown in FIGS. 3A-7B) in the counter-clockwise direction as output shaft 24 returns to its first position (and the door returns to its closed position).

At times, a user may manually operate the door (e.g., open the door, close the door, etc.) to which door operating assembly 10 is coupled. For example, as the door is manually opened, output shaft 24 is rotated in the clockwise direction toward its second position by the motion of the door. First and second linkage gears 66 and 68 are also rotated in the clockwise direction due to the rotationally fixed relationship between first linkage gear 66 and output shaft 24. This rotation of second linkage gear 68 in the clockwise direction carries protrusion 78 away from second protruding surface 62 of protrusion 58 to the configuration of linkage 64 and clutch 79 illustrated in FIGS. 5A and 5B. Consequently, as should be appreciated from FIGS. 5A and 5B, clutch 79 does not engage linkage 64 during manual opening of the door, as protrusions 58 and 78 do not come into contact with each other. Similarly movement of linkage 64 (and output shaft 24) is unimpeded by clutch 79 and motor 32 during manual closing of the door as second linkage gear 68 rotates back to its default position (e.g., illustrated in FIGS. 3A and 3B) from the configuration illustrated in FIGS. 5A and 5B.

Figure 6A:
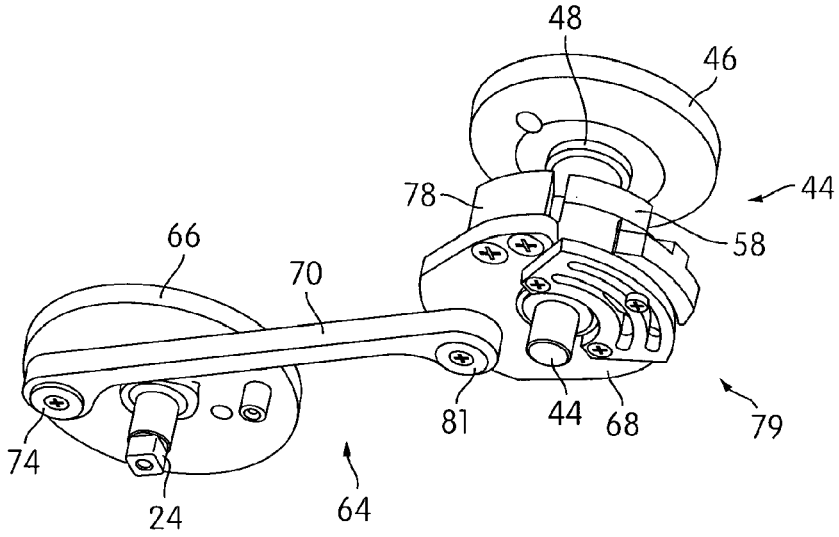
FIGS. 6A and 6B illustrate a linkage and a clutch, in accordance with one or more embodiments of the invention.
Figure 6B:
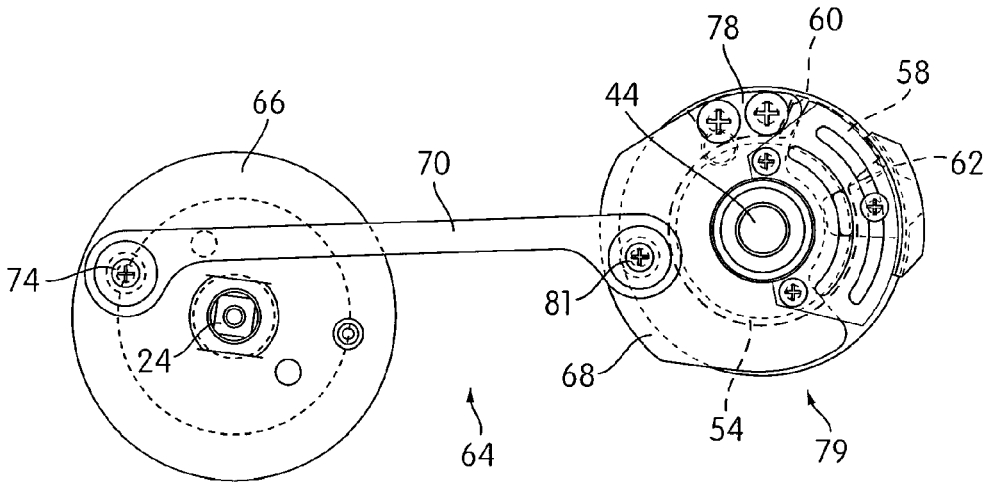

In one embodiment, door operating assembly 10 is operable to engage linkage 64 with clutch 79 to drive the door from its open position to its closed position. As has been discussed above, in FIGS. 5A and 5B, linkage 64 is in the configuration that corresponds to the door being open and drive gear 54 in its default position. From this configuration of linkage 64 and clutch 79 it may be desirable for clutch 79 to engage linkage 64 so that motor 32 can drive linkage 64 to close the door. To accomplish this, from the configuration shown in FIGS. 5A and 5B, drive gear 54 is driven by motor 32 from its default position in the counter-clockwise direction until first protruding surface 60 of protrusion 58 engages protrusion 78 of second linkage gear 68. As motor 32 continues to drive the drive gear 54 in the counter-clockwise direction, the engagement between protrusions 58 and 78 cause the rotation of drive gear 54 to also drive second linkage gear 68 in the counter-clockwise direction. This engagement between protrusions 58 and 78 as drive gear 54 (and second linkage gear 68) are driven in the counter-clockwise direction is illustrated in FIGS. 6A and 6B. More particularly, FIG. 6A is an isometric perspective of this configuration of clutch 79 and linkage 64, and FIG. 6B is an elevation of this configuration of clutch 79 and linkage 64. Once clutch 79 has driven linkage 64 to the point that output shaft 24 has reached its first position (i.e., the door is closed), motor 32 drives drive gear 54 back in the clockwise direction to its default position (i.e., to the configuration shown in FIGS. 3A and 3B).

In one embodiment, linkage 64 is configured such that if the door is overdriven past the open position to which operating assembly 10 drives it (e.g., by manually pushing the door past the open position), rotation of output shaft 24 and first linkage gear 66 in the clockwise direction past the second position of output shaft 24 (e.g., due to the overdriving of the door) causes second linkage gear 68 to rotate in the counter-clockwise direction. This is illustrated by the configuration illustrated in FIGS. 7A and 7B. Specifically, FIG. 7A is an isometric perspective of a configuration of clutch 79 and linkage 64 that illustrates this property of linkage 64, and FIG. 7B is an elevation of this configuration of clutch 79 and linkage 64.

Figure 7A:
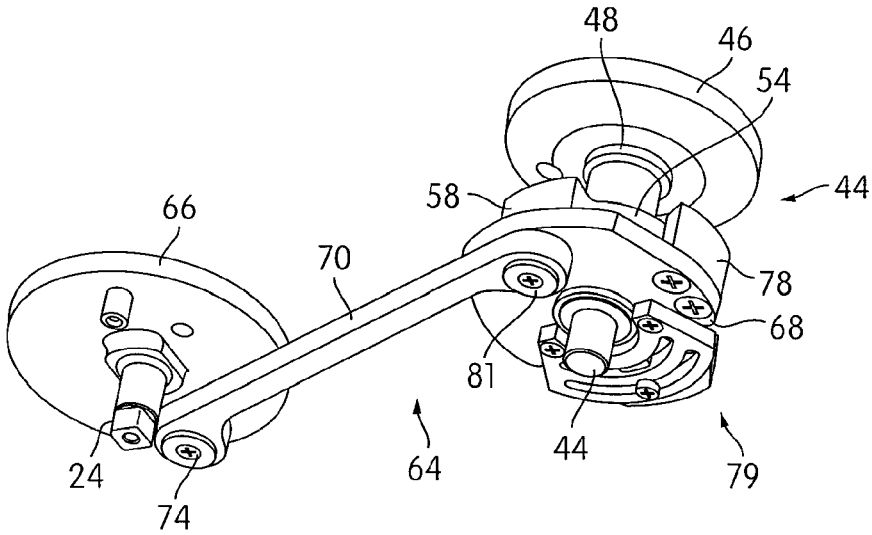
FIGS. 7A and 7B illustrate a linkage and a clutch, in accordance with one or more embodiments of the invention.
Figure 7B:
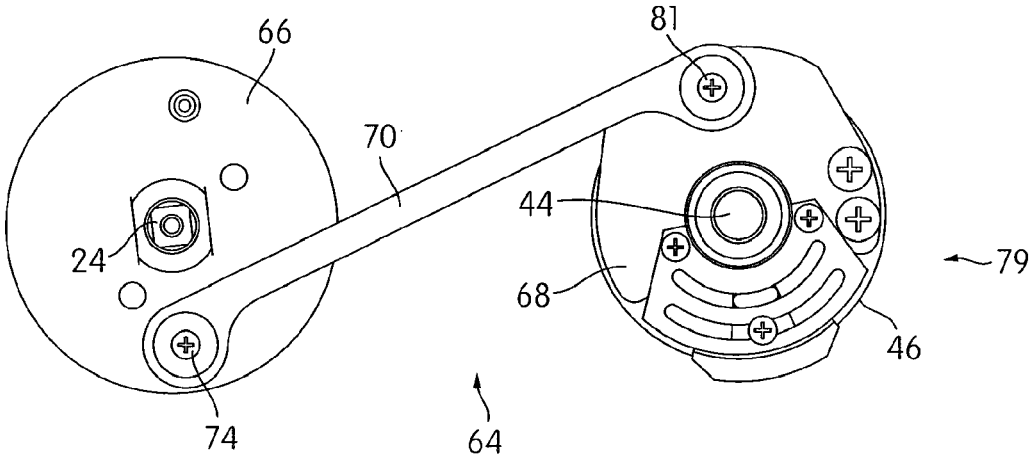

By comparing the configuration of FIGS. 7A and 7B with the configuration of linkage 64 and clutch 79 from FIGS. 5A and 5B, it can be seen that while output shaft 24 and first linkage gear 66 have been overdriven in the clockwise direction past the position of these components when output shaft 24 is in its second position (e.g., as illustrated in FIGS. 5A and 5B). However, by contrast, due to the coupling between linkage gears 66 and 68 by bar 70, the continued rotation of first linkage gear 66 in the clockwise direction has caused second linkage gear 68 to rotate in the counter-clockwise direction from its position when output shaft 24 is in its second position (e.g., as illustrated in FIGS. 5A and 5B). This reversal in the direction of second linkage gear 68 is due to a difference between the radial displacements of pivot points 74 and 81 on linkage gears 66 and 68, respectively. More particularly, the radial displacement of pivot point 74 on first linkage gear 66 is less than the radial displacement of pivot point 81 on second linkage gear 68.

Due to the difference in the radial displacements of pivot points 74 and 81 on linkage gears 66 and 68, if manual operation (or some other phenomenon) causes output shaft 24 to be driven past its second position clutch 79 can engage linkage 64 to enable motor 32 to drive output shaft back to its second position. For example, from the configuration of linkage 64 and clutch 79 shown in FIGS. 7A and 7B, motor 32 may drive the drive gear 54 in the clockwise position until second protruding surface 62 of protrusion 58 contacts protrusion 78 and drives protrusion 78 (and second linkage gear 68) with drive gear 54 in the clockwise position. Because of the connection between linkage gears 66 and 68 formed by bar 70, this rotation of second linkage gear 68 in the clockwise direction causes first linkage gear 66 and output shaft 24 to rotate in the counter-clockwise direction, thereby enabling first linkage gear 66 and output shaft 24 to return to the second position of output shaft 24.

It should be appreciated from the description of FIGS. 3A-7B above that some of the specific aspects of clutch 79 have been provided merely for illustrative purposes, and that it is contemplated that in some embodiments other clutch assemblies may be implemented that provide similar functionality. For example, clutch 79 as shown including protrusions 58 and 78 of drive gear 54 and second linkage gear 68, respectively, may be replaced by another clutch mechanism that provides a hysteresis clutch that selectively engages and disengages linkage 64 with motor 32 such that rotational motion generated by motor 32 may be used to operate the door while still enabling the door to be manually operated without engaging motor 32.

Figure 8:
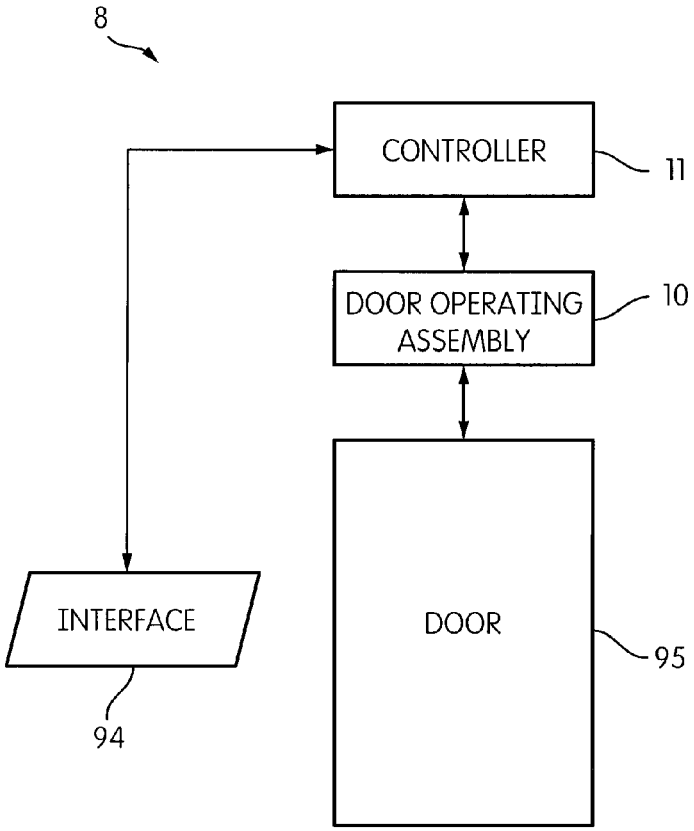
FIG. 8 is a schematic diagram of a door operating system, according to one or more embodiments of the invention.

FIG. 8 is a schematic diagram of door operating system 8, in accordance with one or more embodiments of the invention. In the diagram of FIG. 8, system 8 includes door operating assembly 10, controller 11, and a user interface 94. System 8 is installed to operate a door 95. Controller 11 is in operative communication with user interface 94, which, in one embodiment, includes a display (or a connection port configured to provide a signal to a display).

As was mentioned above, controller 11 is in operative communication with one or more components of operating assembly 10 to provide control information to operating assembly 10 and receive information related to the operation of operating assembly 10 from operating assembly 10. For example, controller 11 may provide control information to operating assembly 10 that controls the operation of motor 32. As another example, controller 11 may receive information related to the operation of motor 32 from operating assembly 10 (e.g., from an encoder associated with motor 32).

In one embodiment, controller 11 models the operation of operating assembly 10 as a state machine based on the information received from operating assembly 10. Information related to the state of the state machine (i.e., operating assembly 10) is conveyed to the user via user interface 94. The user may implement this information, for example, to troubleshoot system 8, during an installation of system 8, during a re-installation of system 8, and/or during a reset of system 8.

Figure 9:
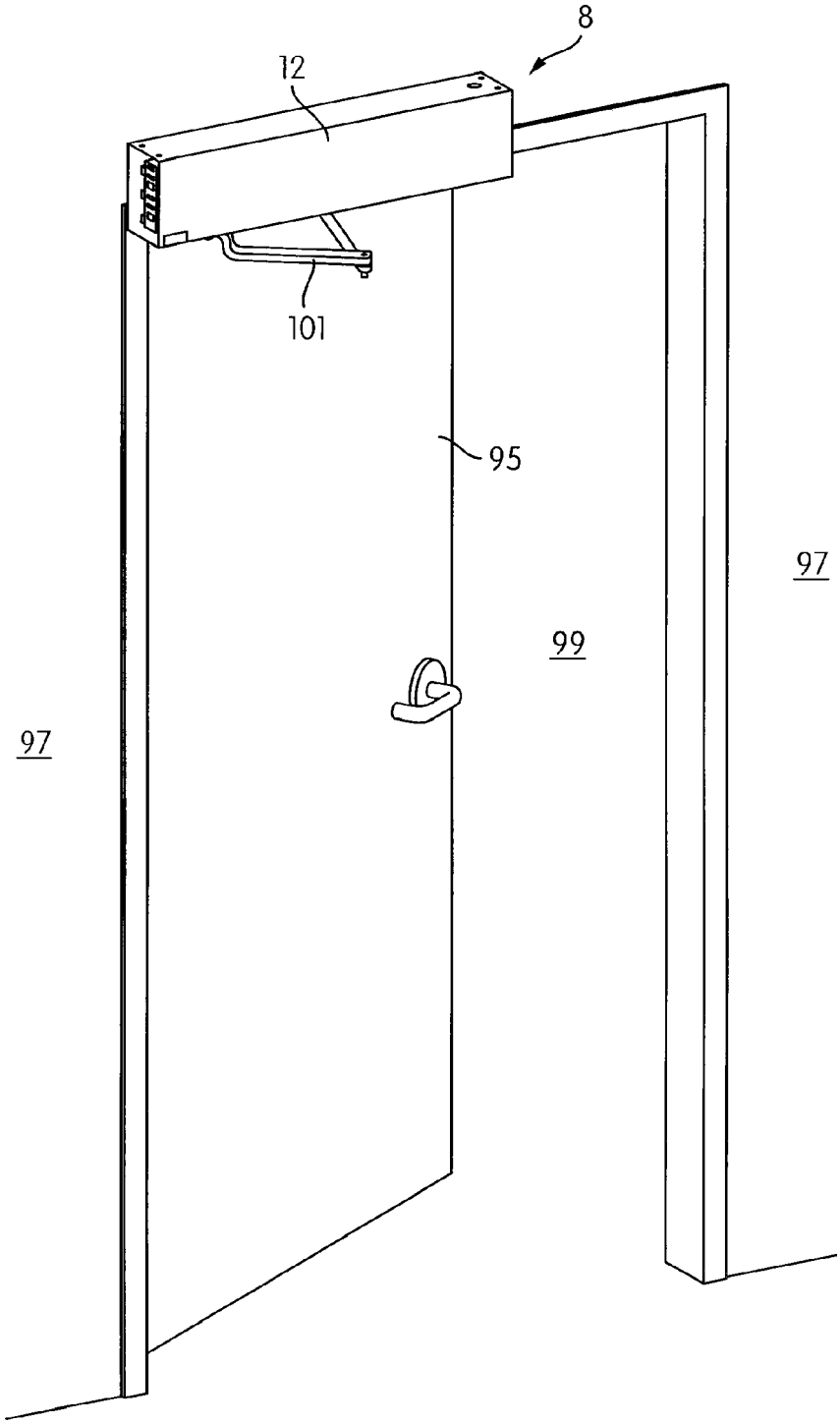
FIG. 9 illustrates a door operating system installed to operate a door, according to one or more embodiments of the invention.

FIG. 9 is a perspective view of door operating system 8 installed to operate door 95. As can be seen in FIG. 9, housing 12 is installed on a wall 97 around a doorway 99 in which door 95 is installed. A secondary linkage 101 coupled to output shaft 24 (not visible in FIG. 9) and door 95 is also shown. As output shaft 24 is driven by door operating system 8, secondary linkage 101 translates the rotational movement of output shaft 24 into rotation of door 95 about its axis of rotation. Similarly, as has been discussed above, due to the coupling of output shaft 24 to door 95 by secondary linkage 101, manual operation of door 95 drives output shaft 24 to rotate.

Figure 10:
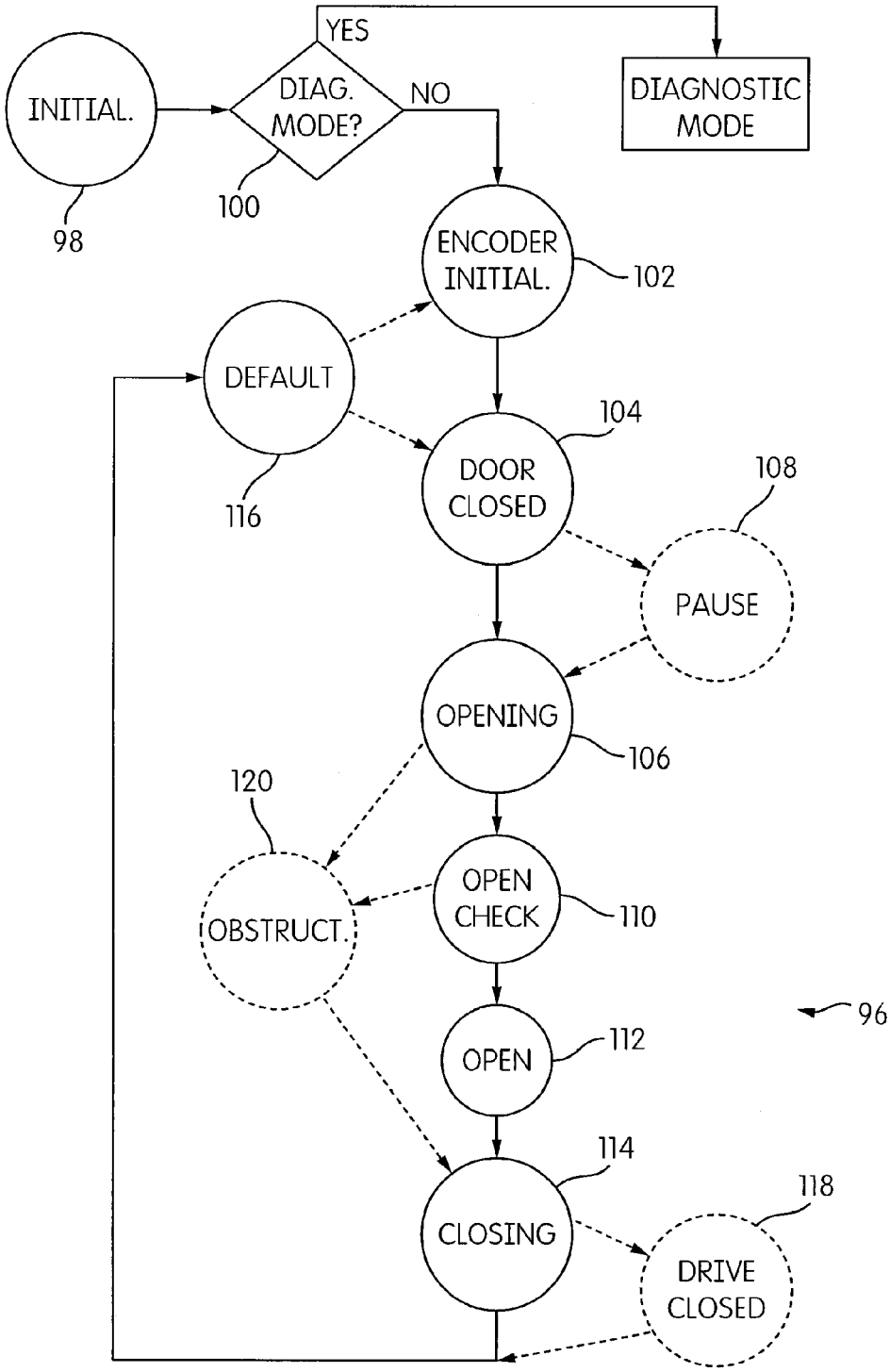
FIG. 10 illustrates flow that may be implemented to model the operation of a door operating system as a state machine, in accordance with one or more embodiments of the invention.

FIG. 10 is a flow 96 that models the operation of a door operating system as a state machine. Although various aspects of flow 96 is described below with respect to door operating system 8 (as shown in FIGS. 1-9 and described above), it should be appreciated that flow 96 may be implemented to describe the operation of other door operating systems as a state machine.

In one embodiment, flow 96 includes and an initialization state 98 at which the door operating system is initiated. This may include powering up one or more components of the system, such as a motor similar to motor 32 (shown and described above) and a controller similar to controller 11 (shown and described above). From initialization state 98, flow 96 passes to a mode determination state 100 where a determination is made as to whether the system is in a diagnostic mode or a normal operation mode. If the system is in the diagnostic mode, then flow 96 continues to the states of the diagnostic mode.

In normal operation, flow 96 passes from state 100 to an encoder initialization state 102. At state 102, an encoder associated with the motor of the system is initialized. In one embodiment, the system uses an absolute position indicator. In this embodiment, the is motor placed at a position that is indicated by the encoder to be a "default" position. For example, the default position may be the position at which the door is closed and the motor is ready to drive the door open. In one embodiment, the system uses an incremental position indicator. In this embodiment, the system may be initialized to determine a reference position of the motor and the motor may then be placed at a default position that is determined relative to the determined reference position. From state 102, flow 96 continues to a door closed state 104, at which the door is closed. Upon receiving a command to open the door, flow 96 moves to a door opening state 106 at which the door is driven open by the door operating system (e.g., with rotational motion generated by the motor) at an opening speed.

In one embodiment, door operating system includes (or is operating in coordination with) an automatic latch (e.g., an electronic strike). In this embodiment, flow 96 proceeds from state 104 to state 106 via a pause state 108. At the pause state 108, door operating system pauses before driving the door open to allow the automatic latch to unlatch.

From state 106, flow 96 proceeds to an open check state 110. At open check state 110, the door operating system reduces the speed of the opening door from the opening speed to an open check speed in anticipation of the door reaching its open position. Thereafter (assuming normal operation), flow 96 continues from open check state 110 to an open state 112, at which the door is in the open position and the door operating system stops driving the rotation of the door.

Once the door operating system reaches open state 110 in flow 96, the system passes to a door closing state 114. In one embodiment, the door operating system does not drive the door closed, but instead allows the door to close without facilitation from the motor. In this embodiment, flow 96 continues from state 114 to a default state 116 at which the motor is operated to return to a default configuration. The default configuration is the configuration in which the motor rests between open commands. When the motor reaches the default configuration, if the operation of the door by the door operating system has been part of a system initialization loop (e.g., executed upon power-up, installation, etc.), then flow 96 passes from state 116 back to state 102. If the operation of the door by the door operating system has been a typical operation of the door, then flow 96 passes from state 116 back to state 104.

Returning to door closing state 114, if the door operating system is configured and/or commanded to drive the door to the closed position, then rather than passing from state 114 straight to state 116, flow 96 instead continues from state 114 to a power close state 118 in which the motor of the door operating system is controlled to drive the door closed. Once the door reaches the closed position, then flow 96 proceeds from state 118 to state 116.

Referring to states 106 and 110, if during either of these states the door and/or the door operating system encounters and obstruction that impedes the opening of the door, then flow 96 passes to an obstruction state 120 rather than continuing to state 112. From obstruction state 120, flow continues to state 114 and the door is closed as described above.

Figure 11:
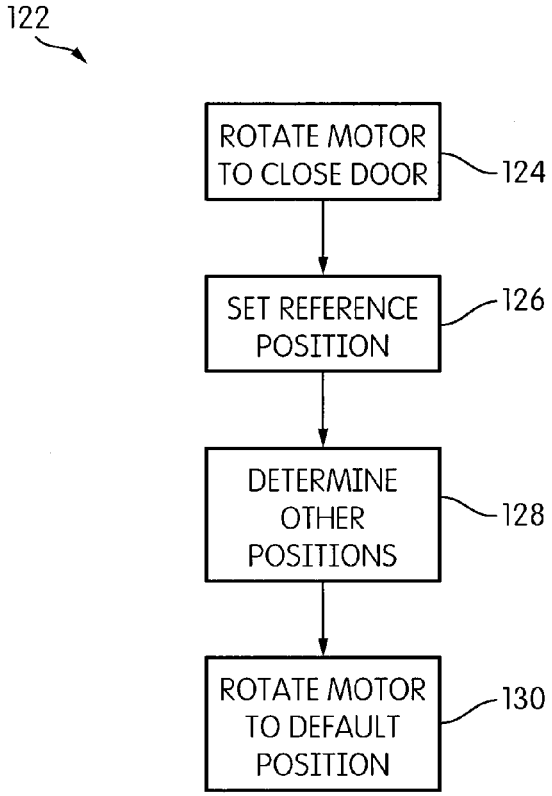
FIG. 11 is a flow chart that illustrates a method of initializing a door operating system, according to one or more embodiments of the invention.

FIG. 11 is a flowchart illustrating a method 122 of initializing a door operating system configured to operate a door, according to one or more embodiments. Initializing the door operating system includes initializing an encoder associated with a motor of the door operating system to determine a reference position of the motor. In one embodiment, the door operating system is initialized each time the system is powered on. Method 122 may be implemented, in one embodiment, at state 102 of flow 96, shown in FIG. 10 and described above.

Method 122 includes an operation 124, at which the motor is controlled to rotate in a direction opposite from the direction that the motor rotates to drive the door open. As the motor rotates during operation 124, the motor eventually reaches a position at which a member associated with the door operating system impedes the rotation of the motor in this direction. In one embodiment, a linkage that is coupled to the door may be configured to impede the rotation of the motor during operation 124 (e.g., because the door is in the closed position). For example, in the door operating system 8, shown in FIGS. 1-7, and described above, motor 32 is controlled to rotate such that drive gear 54 is driven in a counter clockwise direction until protrusion 58 contacts a member of linkage 64 (e.g., protrusion 78 of second linkage gear 68, as shown in FIGS. 6A and 6B).

Referring back to FIG. 11, when the rotation of the motor during operation 124 is impeded, method 122 proceeds to an operation 126. At operation 126, the position of the motor when its rotation is impeded is set as the reference position of the motor. At an operation 128, the rest of the operationally significant positions of the motor are then determined relative to the reference position. These positions may include, for example, a default position of the motor (e.g., as described above with respect to FIG. 10), a door open position of the motor (at which the door has been driven open), and/or other positions. Then, at an operation 130, the motor is controlled to rotate to a default position. For instance, in the example of system 8 shown in FIGS. 1-9 and described above, the default position of the motor is shown in FIGS. 3A and 3B.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A door operator configured to operate a door that is rotatable about an axis of rotation between an open position and a closed position, the door operator comprising:

an output shaft that is axially rotatable between a first axial position and a second axial position, the output shaft being coupled to the door such that rotation of the output shaft rotates the door about the axis of rotation and such that rotation of the door about the axis of rotation rotates the output shaft;

a closing assembly coupled to the output shaft to apply a torque to the output shaft, wherein the torque applied by the closing assembly rotates the output shaft such that the rotation of the output shaft by the closing assembly rotates the door toward the closed position; and a motor that (i) engages the output shaft to apply an opening torque to the output shaft that rotates the output shaft from the first axial position to the second axial position, (ii) disengages the output shaft once the output shaft reaches the second axial position to enable the output shaft to rotate from the second axial position to the first axial position free from engagement with the motor, (iii) allows the output shaft to rotate between the first axial position and the second axial position free from engagement with the motor if the door is manually opened, and (iv) subsequent to disengaging the output shaft once the output shaft reaches the second axial position, selectively re-engages the output shaft to apply a closing torque to the output shaft that rotates the output shaft from the second axial position to the first axial position.

2. The door operator of claim 1, wherein the closing assembly comprises a hydraulic closing assembly.

3. The door operator of claim 1, further comprising a linkage, wherein the motor is coupled to the output shaft by the linkage.

4. The door operator of claim 3, wherein the linkage comprises a four bar linkage with two fixed pivots.

5. The door operator of claim 4, wherein the output shaft forms one of the fixed pivots of the four bar linkage, and wherein the motor is configured to selectively engage the other one of the fixed pivots of the four bar linkage.

6. The door operator of claim 1, wherein the motor is controllable by a user to selectively engage the output shaft to apply the closing torque to the output shaft to rotate the output shaft from the second axial position to the first axial position.

* * * * *